US005786739A

United States Patent [19]

Paul et al.

[11] Patent Number: 5,786,739

[45] Date of Patent: Jul. 28, 1998

[54] INTEGRATED EVANESCENT MODE FILTER WITH ADJUSTABLE ATTENUATOR

[75] Inventors: Jeffrey A. Paul; Chaim Warzman, both of Torrance; Roy Wien, Cerritos; Richard T. Hennegan, Redondo Beach, all of Calif.

[73] Assignee: Hughes Electronics, Los Angeles, Calif.

[21] Appl. No.: 707,277

[22] Filed: Sep. 3, 1996

[51] Int. Cl.[6] ..... H01P 1/207

[52] U.S. Cl. ..... 333/210; 333/26; 333/81 B; 333/248

[58] Field of Search ..... 333/32–35, 81 R, 333/81 B, 26, 210, 247, 248

[56] References Cited

U.S. PATENT DOCUMENTS

| | | | |
|---|---|---|---|
| 2,705,780 | 4/1955 | Weber et al. | 333/35 |
| 3,958,194 | 5/1976 | Klern et al. | 333/81 B |
| 4,458,222 | 7/1984 | Herstern et al. | 333/26 |
| 4,547,901 | 10/1985 | Shibata et al. | 333/208 X |
| 4,803,446 | 2/1989 | Watanabe et al. | 333/26 |
| 4,837,530 | 6/1989 | Kondoh | 333/81 A |
| 4,875,023 | 10/1989 | Maoz | 333/81 R |
| 4,890,077 | 12/1989 | Sun | 333/81 A |
| 4,996,504 | 2/1991 | Huber et al. | 333/81 |
| 5,309,048 | 5/1994 | Khabbaz | 307/542 |
| 5,319,329 | 6/1994 | Shiau et al. | 333/204 |
| 5,485,131 | 1/1996 | Fajen et al. | 333/202 |

FOREIGN PATENT DOCUMENTS

| | | | |
|---|---|---|---|
| 155301 | 6/1990 | Japan | 333/26 |
| 280503 | 11/1990 | Japan | 333/26 |

OTHER PUBLICATIONS

S. Ramo et al., *Fields and Waves in Communication Electronics*, John Wiley & Sons, Inc., 2nd ed., 1984, pp. 444–446.

R. E. Collin, *Foundations for Microwave Engineering*, McGraw–Hill, Inc., 1966, p. 262.

*Primary Examiner*—Seungsook Ham

*Attorney, Agent, or Firm*—Leonard A. Alkov; Wanda K. Denson-Low

[57] ABSTRACT

A waveguide evanescent mode filter is integrated with a monolithic microwave integrated circuit (MMIC) by forming both the MMIC circuitry and the waveguide filter on a single substrate that forms a common ground plane for both elements. The waveguide has a superstructure with an interior recess that is contoured to provide a desired cutoff frequency. The underlying portion of the ground plane can form the lower portion of the waveguide itself, and can also be contoured to define the cutoff frequency. Adjustable attenuation is provided by a resistive card that can be inserted by different amounts into the waveguide.

6 Claims, 2 Drawing Sheets

INTEGRATED EVANESCENT MODE FILTER WITH ADJUSTABLE ATTENUATOR

BACKGROUND OF THE INVENTION

1. Field of the Invention

This invention relates to a waveguide evanescent mode filter with an integrated adjustable attenuator that is compatible for integration on a monolithic microwave integrated circuit (MMIC) module.

2. Description of the Related Art

Waveguide filters can readily achieve low passband insertion loss and high out-of-band rejection, which are characteristics desirable in a filter. It is known that a waveguide has a cutoff frequency below which a signal cannot propagate through the waveguide. For a rectangular waveguide having a width (a), attenuation of the waveguide at a frequency below the cutoff frequency is characterized by the following equation:

$$\alpha = \frac{\pi}{a}\sqrt{1-\left(\frac{f}{f_c}\right)^2} \quad (1)$$

where $\alpha$=attenuation in nepers/meter, a=width of waveguide, f=frequency, $f_c$=cutoff frequency=(c/2a) for the $TE_{10}$ mode, where c is the speed of electromagnetic wave propagation. This waveguide characteristic for a frequency below cutoff is called an evanescent mode, and is described in S. Ramo et al., *Fields and Waves in Communication Electronics,* John Wiley & Sons, Inc., 2nd ed., 1984, pages 444–446.

With this characteristic of the waveguide, a high pass filter can be realized by progressively narrowing the width of the rectangular waveguide to eliminate undesirable low frequency signals and allow high frequency signals to pass through the waveguide. This filter is called an evanescent mode filter.

A thin resistive card may be inserted into the waveguide from a slot opening in one of the broad walls of the waveguide to form an adjustable attenuator, as described in R. E. Collin, *Foundations for Microwave Engineering,* McGraw-Hill, Inc., 1966, page 262. The amount of attenuation can be controlled by adjusting the penetration depth of the card. The attenuator provides attenuation for all frequencies passing through the waveguide.

At microwave and millimeter wave frequencies, passive devices on a MMIC module are typically microstrip or stripline circuit devices, including filters and attenuators. Examples of microstrip or stripline filters for MMIC applications are described in U.S. Pat. Nos. 5,485,131 and 5,319,329. Filters realized in microstrip and stripline circuits generally have high passband insertion loss and poor out-of-band rejection skirts compared to those of a waveguide filter.

Microstrip and stripline circuits exhibit transverse electromagnetic (TEM) field patterns, and passive variable components are difficult to realize in TEM circuits. Variable attenuators have been realized in MMIC circuits by using field-effect transistor (FET) circuits, as disclosed in U.S. Pat. Nos. 4,837,530, 4,875,023, 4,890,077, 4,996,504, and 5,309,048. However, these circuits are complicated and require active components, i.e., FETs. Variable attenuators using purely passive means are difficult to implement in a microstrip or stripline circuit.

In a conventional MMIC module for millimeter wave applications, separate assemblies were required for a filter and an adjustable attenuator, resulting in larger volume, more weight, and higher cost.

SUMMARY OF THE INVENTION

In view of the difficulties of microstrip and stripline microwave and millimeter wave circuits in realizing a filter with satisfactory frequency responses and a feasible adjustable attenuator, the present invention provides a combined waveguide filter and attenuator device that is compatible for integration on a MMIC circuit.

This invention allows a waveguide filter with an adjustable attenuator to be manufactured on a MMIC module, using low cost techniques such as die casting or metallized injection molded plastics, yet provides a filter performance and attenuator adjustability that is matched only by separate waveguide filters and adjustable attenuators. Compared to separate waveguide filters and attenuators, the integrated filter/attenuator realized in this invention is physically smaller and less expensive to implement, and is therefore suitable for commercial applications such as communications and automotive electronics.

In a preferred embodiment, the E-plane, which is the plane along the width of the waveguide, is centered about a flat ground plane, with a single cover section that includes a plurality of impedance transformers as the filter section. This allows one wall of the waveguide to be opened up to accept a thin resistive card, which attenuates the signals passing through the center waveguide section. The penetration of the card into the waveguide is adjustable by moving the card from outside the waveguide thereby providing variable attenuation to the signals.

These and other features and advantages of the invention will be apparent to those skilled in the art from the following detailed description, taken together with the accompanying drawings, in which:

DETAILED DESCRIPTION OF THE INVENTION

The present invention provides an integrated waveguide filter and attenuator that is easily fabricated on a monolithic microwave integrated circuit (MMIC) module with good performance, low cost, and high yield in manufacturing.

Figure 1:
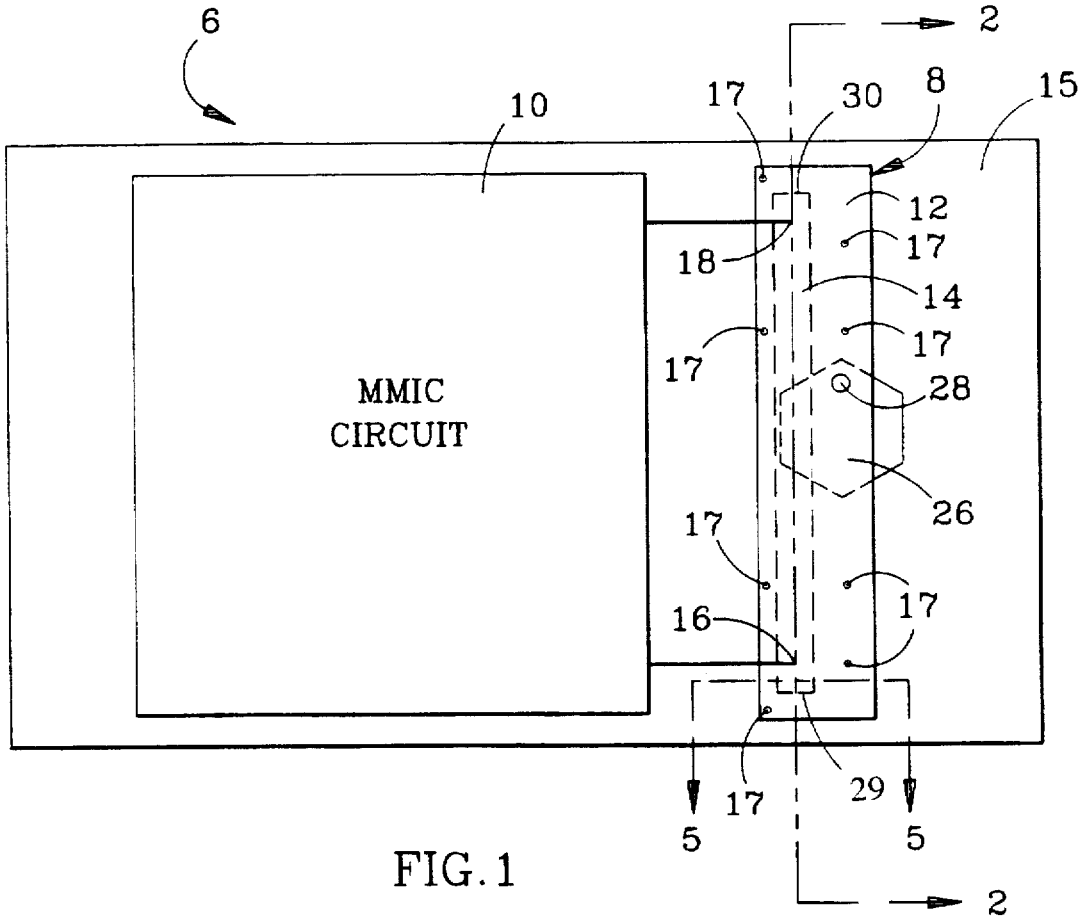
FIG. 1 is a plan view of a MMIC module which has a filter/attenuator top assembly with probe couplings at the input and the output of the filter in accordance with the invention.

FIG. 1 shows a MMIC module 6 upon which a filter/attenuator 8 and other parts of a MMIC circuit 10 are integrated. The filter/attenuator 8 has a top assembly 12 which covers a waveguide 14. The top assembly 12 is preferably fastened to a ground plane 15 of the MMIC module 6 by a plurality of screws 17. The waveguide 14 has a hollow interior surrounded by conductive walls and is defined by the top assembly 12 and the ground plane 15. The waveguide 14 has an input coupling probe 16 near one end for receiving microwaves, and an output coupling probe 18 near the other end for transmitting filtered and/or attenuated waves.

Figure 2:
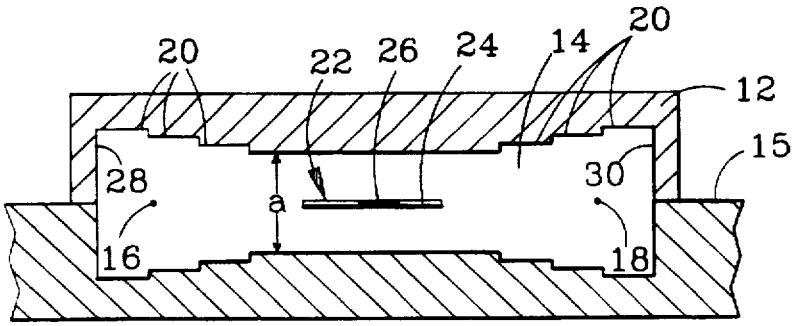
FIG. 2 is a sectional view taken along the section line 2—2 of FIG. 1, showing step variations in the recessed ground plane and top assembly portions of the waveguide.

The waveguide 14 includes a plurality of impedance transformers 20, which are variations in the width of the waveguide 14 along its length, shown in FIG. 2. When the waveguide is used for a high pass filter, the waveguide's width narrows beyond the input coupling to reject input microwave frequencies below the cutoff frequency. The cutoff frequency $f_c$ of the $TE_{10}$ mode of a rectangular waveguide is determined by the width (a) of the waveguide by the relationship $$f_c = \frac{c}{2a} \tag{2}$$

where c is the speed of electromagnetic wave propagation. For a rectangular waveguide, $TE_{10}$ mode is the dominant mode of propagation and has the lowest cutoff frequency.

At frequencies below the cutoff frequency, input signals attenuate and do not propagate through the waveguide. The attenuation within a rectangular waveguide below cutoff frequency is characterized by equation (1) given previously.

A high pass filter is realized by decreasing the width of the waveguide 14. For low cost and reliable manufacture of the filter, it is preferred that the waveguide cross-section be abruptly changed at discrete locations along its length. In a preferred embodiment, a plurality of step impedance transformers 20 are implemented along the length of the waveguide 14. Each of the transformers 20 has a length of approximately one-quarter wavelength between adjacent step discontinuities for impedance matching. Preferably, the transformers are formed by machining the top assembly 12 and the ground plane 15 using the techniques of electrodynamic machining, casting or stamping. The narrowest width (a) of the waveguide determines the cutoff frequency $f_c$ of the filter. A section 22 of the waveguide has a slot opening 24 for receiving a thin resistor card 26 that penetrates into the interior of the section 22. The slot opening 24 is preferably flush with the top surface of the ground plane 15. The resistor card 26 acts as a variable attenuator that attenuates signals of all frequencies traveling through the waveguide. The resistive card 26 is preferably made of a high-resistance material such as carbon. The resistor card 26 is movable so that its penetration into the waveguide is adjustable. In a preferred embodiment, one end of the resistor card 26 is held by a pivot 28 and is rotatable about the pivot 28. The resistor card 26 is adjusted by manually rotating it, and is held in place by the frictional force between the pivot 28 and the resistor card 26. The attenuation of all signal frequencies in the waveguide increases as the resistor card 26 penetrates deeper into the waveguide section 22.

The waveguide may have many different cross-sectional shapes, such as rectangular, circular, elliptical or oblong. For easy manufacturing of the waveguide on a MMIC module using techniques such as die casting or metallized injection molded plastics, it preferably has a rectangular cross-section.

Coupling of microwave energy into and out of the waveguide 14 are achieved by the input probe 16 and the output probe 18 respectively. The probes 16 and 18 are conductive transmission line segments that partially penetrate into the broad wall of the waveguide 22, near the short-circuit ends 29 and 30 of the waveguide. Because the integrated filter with adjustable attenuator has a substantially symmetrical side cross-section, the input and output of the device is interchangeable in operation.

Figure 3:
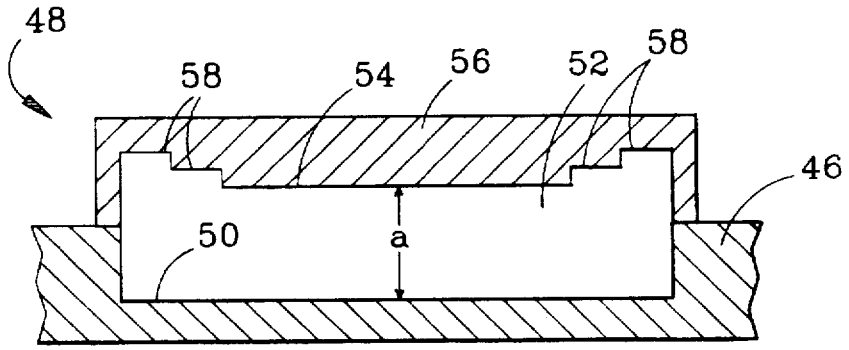
FIG. 3 is a sectional view of another embodiment similar to FIG. 2, but with step variations only in the top assembly portion of the waveguide.

In a preferred embodiment, shown in FIG. 3, the ground plane 46 of a MMIC module 48 has a recess 50 which forms a portion of waveguide 52, but the recessed portion 50 is flat throughout the length of the waveguide and does not contain step discontinuities. In the top waveguide portion 54 defined by top assembly 56, a series of step transformers 58 each having a length of approximately one-quarter wavelength are formed by abrupt changes at discrete locations only in the top assembly portion 54 of the waveguide 52. Because the ground plane 46 of the MMIC module 48 has one flat rectangular recess without any variations in the depth of the recess, this configuration enables low cost and high yield manufacturing of the filter/attenuator device.

Figure 4:
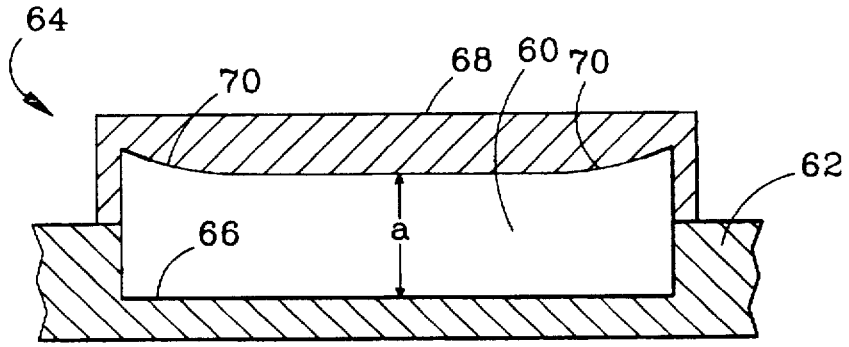
FIG. 4 is a sectional view of another embodiment similar to FIGS. 2 and 3, but with tapered variations in the top assembly portion of the waveguide.

In another configuration, shown in FIG. 4, the step transformers of FIGS. 2 and 3 are replaced by a tapered variation in the width of the waveguide 60 along its length. The ground plane 62 of the MMIC module 64 has a flat rectangular recess 66 to form the lower portion of the waveguide 60. The top assembly 68 provides the top portion of the waveguide 60 and has tapered transitions 70 from the two ends of the waveguide 60 to the center. The narrowest width (a) in the waveguide determines its cutoff frequency.

Figure 5:
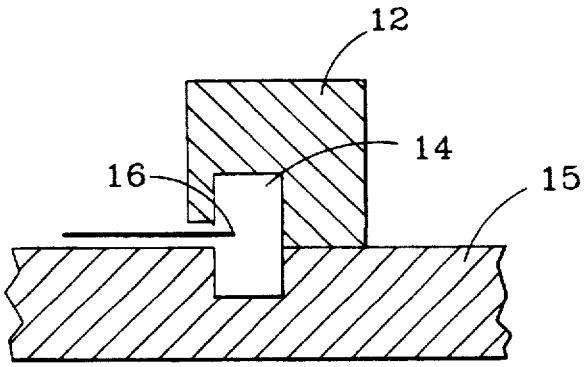
FIG. 5 is an end sectional view taken along the section line 5—5 of FIG. 1, showing the ends of the waveguide in the embodiments of FIGS. 2, 3, and 4.

Many possible configurations exist for coupling microwave energy into and out of the waveguide filter and attenuator device. In a preferred embodiment that facilitates implementation of input and output couplings in a waveguide on a MMIC module, probes are used to couple energy into and out of the device. In FIG. 5, the ground plane 15 is partially recessed and is aligned with the top assembly 12 to form a rectangular waveguide 14. The MMIC probe 16, which is a conductive transmission line segment extended from a stripline or a microstrip, penetrates partially into the waveguide 14. The length of the probe penetration and the distance of the probe 16 from the waveguide's short-circuit end 28 are precisely determined to minimize reflection and losses when microwave energy is coupled into or out of the waveguide 14 through the probe 16.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. An integrated monolithic microwave integrated circuit (MMIC) and evanescent mode waveguide filter, comprising:

a MMIC having a conductive substrate;

a first recess formed in said substrate, said first recess defining a first waveguide portion;

a cover having a second recess that defines a second waveguide portion, said cover carried on said substrate and positioned with said first recess and said second recess aligned;

said first and second recesses each terminating in respective first and second ends with at least one of said first recess and said second recess having a narrowed section between its first and second ends;

an evanescent mode waveguide filter thus formed by said first and second waveguide portions and having a cutoff frequency substantially established by said narrowed section; and first and second microwave signal couplings arranged to couple said MMIC to said evanescent mode waveguide filter on opposite sides of said narrowed section.

2. The integrated MMIC and evanescent mode waveguide filter of claim 1, wherein said narrowed section defines a plurality of step discontinuities.

3. The integrated MMIC and evanescent mode waveguide filter of claim 1, wherein said narrowed section is defined by tapered transitions between said narrowed section and its respective first and second ends.

4. The integrated MMIC and evanescent mode waveguide filter of claim 1, wherein said first and second microwave signal couplings respectively comprise first and second probes which extend from said MMIC and respectively penetrate into said evanescent mode waveguide filter adjacent to the first and second ends of at least one of said first recess and said second recess.

5. The integrated MMIC and evanescent mode waveguide filter of claim 1, wherein at least one of said first and second recesses includes an opening and further including a resistive card that is movably positioned in said opening.

6. The integrated MMIC and evanescent mode waveguide filter of claim 1, wherein said evanescent mode waveguide filter has a rectangular cross-sectional shape.

* * * * *